US012648599B2

(12) United States Patent
Stevens

(10) Patent No.: US 12,648,599 B2
(45) Date of Patent: Jun. 9, 2026

(54) CLOTHING ARTICLE WITH INTEGRATED SMOKING DEVICE FOR USE WITH VAPORIZERS

(71) Applicant: Fire Designs, LLC, Anchorage, AK (US)

(72) Inventor: James Stevens, Anchorage, AK (US)

(73) Assignee: Fire Designs, LLC, Anchorage, AK (US)

( * ) Notice: Subject to any disclaimer, the term of this patent is extended or adjusted under 35 U.S.C. 154(b) by 0 days.

(21) Appl. No.: 18/772,828

(22) Filed: Jul. 15, 2024

(65) Prior Publication Data

US 2025/0017292 A1 Jan. 16, 2025

Related U.S. Application Data

(60) Provisional application No. 63/526,528, filed on Jul. 13, 2023.

(51) Int. Cl.
*A41D 1/00* (2018.01)
*A41D 27/10* (2006.01)

(52) U.S. Cl.
CPC ..... *A41D 1/002* (2013.01); *A41D 27/10* (2013.01); *A41D 2300/322* (2013.01)

(58) Field of Classification Search
CPC . A41D 27/201; A41D 27/00; A41D 2300/322
USPC ..... 2/1
See application file for complete search history.

(56) References Cited

U.S. PATENT DOCUMENTS

| | | | | |
|---|---|---|---|---|
| 9,332,796 | B2 * | 5/2016 | Edwards | A41D 1/04 |
| 10,537,144 | B1 * | 1/2020 | Suttman | A42B 3/048 |
| 2006/0080756 | A1 * | 4/2006 | Goldfine | A61F 7/007 2/102 |
| 2014/0304885 | A1 * | 10/2014 | Oliver | A41D 1/04 2/84 |
| 2015/0196061 | A1 | 7/2015 | Oliver | |
| 2016/0309819 | A1 * | 10/2016 | Edwards | A41D 1/04 |
| 2021/0244108 | A1 * | 8/2021 | Lee | A41D 13/015 |

OTHER PUBLICATIONS

PCT International Search Report & Written Opinion dated Dec. 9, 2024, Application No. PCT/US2024/038020.

The Vape Hoodie—This Actually Exists? (Vaping Insider) Apr. 2, 2019, retrieved from internet Nov. 25, 2024, URL=https://wwwyoutube.com/watch?v=y4zInFy9M1A> entire document.

* cited by examiner

*Primary Examiner* — Timothy K Trieu
(74) *Attorney, Agent, or Firm* — The Dobrusin Law Firm, P.C.

(57) ABSTRACT

A clothing article featuring an integrated vapor cartridge system for delivering vapor near the wearer's face. The sweatshirt includes a collar section with an internal pocket that houses a hose connected to a vapor cartridge, with an access opening on the rear portion of the hood, collar, or torso. Additionally, a universal connector for the vapor cartridge is provided, ensuring a secure and adaptable connection between the vapor cartridge and the hose.

1 Claim, 11 Drawing Sheets

CLOTHING ARTICLE WITH INTEGRATED SMOKING DEVICE FOR USE WITH VAPORIZERS

CROSS-REFERENCE TO RELATED APPLICATIONS

This application claims priority to U.S. Provisional Patent Application No. 63/526,528 filed on Jul. 13, 2023, and entitled CLOTHING ARTICLE WITH INTEGRATED SMOKING DEVICE FOR USE WITH VAPORIZERS, which is hereby incorporated by reference.

TECHNICAL FIELD

The present specification generally relates to a smoking device and, more specifically, a smoking device that is integrated into a clothing article.

BACKGROUND

Vaporizers, otherwise known as vapes, are commonly used to generate smoke or vapor for inhalation by a user (hereinafter interchangeably referred to as "vaporizer" or "smoke producer" and may include vaporizers, vapes, and/or other smoking devices producing either smoke and/or vapor). Existing smoke producers or vaporizers are used by raising the vaporizer to the user's mouth and inhaling while the vaporizer produces smoke or vapor. Vaporizers are commonly used alone, without being integrated with any other device. Furthermore, vaporizers come in only limited numbers of standard formats. A large quantity of vaporizers used by users are of the C-Cell style. These C-Cell vaporizers and all other vaporizers could benefit from a smoking device which enhances the use of a vaporizer.

Vaporizers can have relatively small sizes which are easy for a user to lose. Clothing articles currently available do not have specialized pockets designed to securely store a vaporizer. Vaporizers can be pen-shaped, where the length is much greater than the diameter, which make them particularly challenging for generic, non-specialized pockets to hold. Accordingly, there exists a need in the art to provide a clothing article with a pocket which more securely stores a vaporizer and eliminates the need to remove the vaporizer during use.

Currently known clothing articles designed to interact with vaporizers are inadequate. Adapters used on existing devices are flexible rubber tubes which are intended to adapt to any vaporizer shape. These rubber tubes fail to properly seal against vaporizers and result in poor performance of the device. An adapter which is designed to conform to only one vaporizer style results in superior sealing performance. Accordingly, an adapter with a superior sealing ability is needed in the art.

Existing integrated smoking devices also suffer from poor device stability. Existing devices use a zipper on an article of clothing which must be unzipped to release or insert the hose of a smoking device. The zipper can be prone to failure resulting in unintended separation of the smoking device or the smoking device becoming irremovable. Furthermore, existing adapters on smoking devices rely strictly on a smooth interference fit between an adapter and a hose. This connection is prone to failure because the adapter can separate from a hose too easily because of insufficient frictional force. Accordingly, an improved integrated smoking device will improve device stability by not utilizing a zipper and using an improved connection on adapters to prevent separation from a hose.

In cold weather, vaporizers are prone to freezing. Taking a vaporizer out of a pocket for each use can result in the vaporizer freezing. Accordingly, there exists a need in the art to provide an integrated smoking device that does not require removal of a vaporizer to use a vaporizer, where the vaporizer may remain in a pocket during use and absorb body heat to prevent freezing.

Some vaporizers can be heavy and repeated lifting of these vaporizers can be strenuous. Removal of a vaporizer from a pocket for each use of the vaporizer can be a strenuous activity. Accordingly, a vaporizer without the need to lift or even remove the vaporizer from a pocket is needed in the art.

Accordingly, there exists a need in the art to provide an improved integrated smoking device overcoming the aforementioned disadvantages.

SUMMARY

The present clothing article provides a novel hooded sweatshirt designed for comfort and functionality, integrating a vapor delivery system discreetly within the collar—in one embodiment. Other embodiments include other shirts or windbreakers having similar structure with varying materials. The integrated hose and vapor cartridge system allows users to enjoy vapor near their face with minimal visibility and easy access for maintenance or replacement. The accompanying universal connector ensures compatibility and secure attachment of the vapor cartridge, enhancing the overall user experience.

A hooded sweatshirt including a torso covering portion including a front torso portion and a rear torso portion, a hood attached to the torso covering portion, the hood having a rear portion, a collar section positioned between the torso covering portion and the hood, the collar section configured to be positioned around a user's neck, the collar section having an internal pocket extending around the user's neck, a pair of sleeves extending from the torso covering portion, a pocket located on the front side of the torso covering portion, a hose with a vapor cartridge integrated into the collar, the hose having an outlet positioned near the wearer's face, the hose positioned within the internal pocket, and an access opening positioned on the rear portion of the hood or the rear torso portion, the access opening only being large enough to access a portion of the hose. In some embodiments, the access opening is accessible via a zipper. In some embodiments, the access opening is not larger than 4 inches. In some embodiments, the access opening is between 1 and 5 inches in length.

A vapor cartridge universal connector, the connector for use with a hooded sweatshirt with an integrated vapor cartridge, the hooded sweatshirt including a hose positioned around the collar of a user's neck, the vapor cartridge universal connector including a main housing, the main housing configured to connect to the vapor cartridge, a secondary housing connected to the main housing, the secondary housing having a first portion and a second portion in a split shell configuration, and a barb connector, the barb connector positioned between the first portion and the second portion of the secondary housing, the barb connector inserted into the hose of the hooded sweatshirt wherein the split shell configuration of the secondary connector configured to tightly compress around the barb so as to securely connect the universal connector and the vapor cartridge to the hose.

BRIEF DESCRIPTION OF THE DRAWINGS

The embodiments set forth in the Figures are illustrative and exemplary in nature and not intended to limit the subject matter. The following detailed description of the illustrative embodiments can be understood when read in conjunction with the appended Figures, where like structure is indicated with like reference numerals and in which.

DETAILED DESCRIPTION

Figure 1:
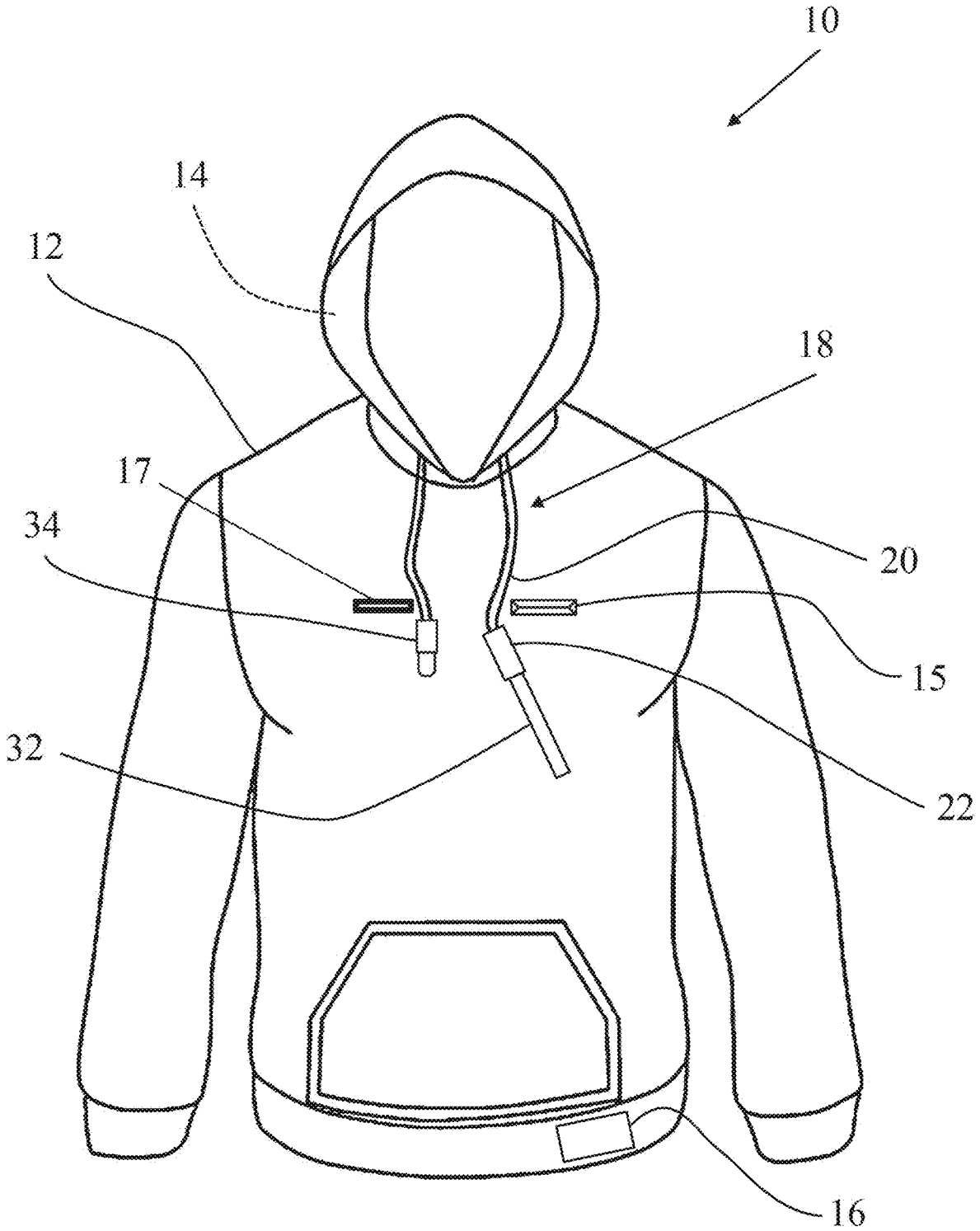
FIG. 1 is a front view of an integrated smoking device in accordance with one or more embodiments shown and described herein.

The clothing article with integrated smoking device for vaporizers of the present specification generally includes a clothing article with a pocket and at least one hose enabling a user to use and store a smoke producer while wearing the clothing article. A clothing article combined with a smoking device is hereby referred to as an integrated smoking device. A smoking device of the present specification transfers smoke from a smoke producer to a user. A smoking device includes a mouthpiece for a user to inhale through. A smoking device transfers smoke or vapor to a mouthpiece through a hose and an adapter which connects to a smoke producer. A smoking device creates a sealed channel between a mouthpiece and a smoke producer. A user can inhale through a mouthpiece and the resultant decrease in relative pressure in the sealed channel may draw smoke from a smoke producer to a user. A smoking device may be contained within a clothing article which forms an integrated smoking device.

An integrated smoking device of the present specification includes a smoking device and a clothing article. An integrated smoking device is designed for use with a smoke producer which produces either smoke or vapor. A hose of a smoking device can reside in a clothing article. An integrated smoking device may be worn by a user. An integrated smoking device provides convenience and superior performance in the consumption of smoke or vapor by a user. A user may store a smoke producer attached to a smoking device in a pocket of a clothing article. A user may draw and inhale smoke or vapor from a smoke producer without removing the smoke producer from a pocket.

The goals of the integrated smoking device include user convenience, improved performance, and device stability. User convenience is achieved by an integrated smoking device. User convenience is achieved by not requiring removal of a smoke producer from a pocket for each use, the pocket securely storing a smoke producer, passive heating of the smoke producer, and a mouthpiece of the smoking device resting in a convenient location for a user. A user may draw smoke or vapor from a smoke producer while it is in a pocket by simply drawing on a mouthpiece while the smoke producer is in the pocket. The ability to draw smoke or vapor without removing a smoke producer from a pocket prevents fatigue in a user. A smoking device may be secured within a hood of a clothing article and gravity may pull the mouthpiece such that it resides on a user's chest. A pocket securely stores a smoke producer by having an internal cavity which is only slightly larger than a smoke producer. Additionally, the close proximity of a pocket to a user's body has the added benefit of absorbing excess heat being released by the user. This body heat sufficiently warms a smoke producer such that it does not freeze. Each of these benefits improves user convenience.

Improved performance can be achieved by an integrated smoking device. An integrated smoking device uses an adapter which is designed to fit only certain smoke producers instead of any smoke producer. The design of an adapter for specific smoke producers creates an enhanced seal between those specific smoke producers and the adapter. The enhanced seal allows for a user to draw more smoke vapor with each draw using the smoking device.

Device stability of an integrated smoking device may be achieved by an improved adapter, mouthpiece, or both and also an improved clothing article. An adapter, mouthpiece, or both may have a hose interface which includes hose grippers to improve grip on a hose. An adapter, mouthpiece, or both may improve grip on a hose by having hose grippers which create enhanced frictional forces in addition to non-frictional forces on the hose. A clothing article may increase stability of the device by not having a zipper for removal or insertion of a smoking device. A hose of a smoking device with an adapter, a mouthpiece, or both removed may be inserted into a permanently enclosed channel in a clothing article and subsequent attachment of the mouthpiece, the adapter, or both holds the smoking device captive in the clothing article.

An integrated smoking device of the present specification may include a clothing article. A clothing article may be worn by a user. A clothing article may be a shirt or sweatshirt. A clothing article may be made of one or more cloth materials. The one or more cloth materials may be cotton, polyester, cotton-polyester blends, nylon, spandex, wool, leather, silk, other synthetic materials any variants thereof, or any combination thereof. A clothing article may have short sleeves, long sleeves, or no sleeves. A clothing article may have a hood. A hood, other portion of the clothing article, or both may have a clothing article passage. A clothing article may have a pocket for storage on the clothing article. A clothing article may have a warning tag attached thereto.

A clothing article of the present specification may include a clothing article passage. A clothing article passage may join a smoking device to a clothing article. A clothing article passage may contain a hose of a smoking device. A clothing article passage may not allow for an adapter or a mouthpiece of a smoking device to enter the clothing article passage. A clothing article passage may prevent separation of a clothing article and a smoking device by containing a central portion of a hose which has an adapter at one end and a mouthpiece at an other end. A clothing article passage may be any passage through a clothing article with at least two openings. A clothing article passage may be located around the front edge of a hood of a clothing article.

A clothing article of the present specification may include a pocket. A pocket may be used to store a smoke producer. A smoke producer may reside in a pocket while the smoke producer is supplying smoke or vapor to a user. The pocket may be on a front surface of a clothing article. The pocket may be positioned such that it is located over a user's chest when a user wears a clothing article. The pocket may have interior dimensions which can accommodate a C-Cell style smoke producer or other smoke producer shapes.

A clothing article of the present specification may include a warning tag. A warning tag may warn potential users. A warning tag may communicate age restrictions, use risks, or both. A warning tag may be a section of material that is affixed to a clothing article. A warning tag may be affixed to a clothing article by sewing, adhesive, or other attachment means. A warning tag may be a section of a clothing article. A warning tag may be directly printed onto a clothing article using ink, laser marking, or other marking methods. The warning tag may have a written message which warns a user.

An integrated smoking device of the present specification includes a smoking device. A smoking device may be used to transfer smoke or vapor from a smoke producer to a user. A smoking device may include a hose, an adapter, and a mouthpiece. A user may inhale through a mouthpiece and pull smoke or vapor produced by a smoke producer through an adapter and a hose. A smoking device may be removably attached to an article of clothing.

A smoking device of the present specification may include a hose. A hose may connect an adapter to a mouthpiece. A hose may put an adapter and a mouthpiece in fluid communication. A hose may transfer smoke or vapor between an adapter and a mouthpiece. A hose may be a hose, tube, or any other hollow cylindrical component capable of transferring smoke or vapor. A hose may be a plastic, rubber, composite, or combination thereof. A hose may be made of polyethylene, polyvinyl chloride (PVC), nylon, polyurethane, or other thermoplastics. A hose may have one end and an other end. A hose may have an adapter at one end and a mouthpiece at an other end, or vice versa. A hose may have an adapter, a mouthpiece, or both removably attached to the hose. A hose may have an adapter, a mouthpiece, or both permanently attached to the hose.

A smoking device of the present specification may include an adapter. An adapter may connect a smoke producer to a hose. An adapter may connect to a hose through a hose interface. An adapter may connect to a smoke producer through a smoke producer interface. An adapter may transfer smoke produced by a smoke producer through the adapter and into a hose when a user draws on a smoking device. An adapter may be a plastic, rubber, composite, or combination thereof. An adapter may be made of polyethylene, polyvinyl chloride (PVC), nylon, polyurethane, or other thermoplastics. An adapter may be made of natural rubber, styrene-butadiene rubber (SBR), butyl, nitrile, neoprene, or other rubbers. The hose or tubing can be made of high quality plastic or silicone suitable such as home food grade silicone, medical grade silicone, or other similar materials.

An adapter of the present specification may include a hose interface. A hose interface may removably bind an adapter to a hose. A hose interface may removably bind to a hose through an interference fit connection, threaded connection, mating feature, or other reversible connection. A hose interface may be at an opposite end of an adapter as a smoke producer interface. A hose interface may be a cylindrical hole in an adapter. A hose interface may be a cylindrical hole with a diameter equal to, greater than, or less than an outer diameter of a hose. A hose interface may have one or more surface features on its surface which are hose grippers.

A hose interface, a mouthpiece hose interface, or both of the present specification may include hose grippers. Hose grippers may enhance the strength of connection between an adapter and a hose, a mouthpiece and a hose, or both. Hose grippers may enhance connection to a hose by increasing total friction between an adapter, a mouthpiece, or both and a hose, mechanically engaging with a hose, or both. Increasing total friction may include use of barbed features, serrations, ribbing, threading, or other surface features which create local friction peaks, use of a hose interface with a diameter small enough to compress a hose, or both. Mechanically engaging with a hose may include use of barbed features, serrations, ribbing, threading, or other surface features which create non-frictional forces. A hose interface may consist of barbed features, serrations, ribbing, threading, or other surface features on a surface of an adapter, a mouthpiece, or both. A hose interface may consist of a mix of barbed features, serrations, ribbing, threading, or other irregularities.

An adapter of the present specification may include a finger grip. A finger grip may ease removal of an adapter from a hose, an adapter from a smoke producer, or both. A finger grip may assist a user in generating force on an adapter. A finger grip may be an area of an adapter which has a locally reduced exterior outer diameter. A finger grip may have a surface texture which enhances a user's grip on an adapter.

An adapter of the present specification may include a smoke producer interface. A smoke producer interface may removably connect an adapter to a smoke producer. A smoke producer interface may removably connect to a smoke producer by increasing total friction between a smoke producer and an adapter, mechanically engaging with a smoke producer, conforming to the shape of a smoke producer, or any combination thereof. Increasing total friction may include use of barbed features, serrations, ribbing, threading, or other irregularities which create local friction peaks, use of a smoke producer interface with a shape small enough to compress a smoke producer, or both. Mechanically engaging with a smoke producer may include use of barbed features, serrations, ribbing, threading, or other irregularities which create non-frictional forces. Conforming to the shape of a smoke producer may mean that a smoke producer interface has a shape which mirrors the shape of a smoke producer. A smoke producer interface may conform to a smoke producer which is a standard smoke producer. A standard smoke producer may be a C-Cell style smoke producer or an other standard smoke producer. The C-Cell style smoke producer may be a CCell cartridge, manufactured by Shenzhen Smoore Technology Limited, of Kowloon, Hong Kong. A smoke producer interface may consist of barbed features, serrations, ribbing, threading, or other irregularities on a surface of an adapter. A smoke producer interface may consist of a mix of barbed features, serrations, ribbing, threading, or other irregularities.

A smoking device of the present specification may include a mouthpiece. A mouthpiece may provide a surface for a user to inhale smoke or vapor. A mouthpiece may provide smoke or vapor from a smoke producer by transferring smoke or vapor from a hose to a user. A mouthpiece may be a plastic, rubber, composite, or combination thereof. A mouthpiece may be made of polyethylene, polyvinyl chloride (PVC), nylon, polyurethane, or other thermoplastics. A mouthpiece may be made of natural rubber, styrene-butadiene rubber (SBR), butyl, nitrile, neoprene, or other rubbers. A mouthpiece may have a mouthpiece hose interface which to attach the mouthpiece to a hose. A mouthpiece may have a mouthpiece hole to transfer smoke or vapor to a user. A mouthpiece may have a mouth interface for a user to interact with.

A mouthpiece of the present specification may include a mouthpiece hose interface. A mouthpiece hose interface may removably bind a mouthpiece to a hose. A mouthpiece hose interface may removably bind to a hose through an interference fit connection, threaded connection, mating feature, or other reversible connection. A mouthpiece hose interface may be at an opposite end of a mouthpiece as a mouth interface. A mouthpiece hose interface may be a cylindrical hole in a mouthpiece. A mouthpiece hose interface may be a cylindrical hole with a diameter equal to, greater than, or less than an outer diameter of a hose. A mouthpiece hose interface may have one or more surface features on its surface which are hose grippers.

A mouthpiece of the present specification may include a mouthpiece hole. A mouthpiece hole may be the passage that smoke or vapor travels through between a hose and a user. A mouthpiece hole may be an axial hole which extends from a mouthpiece hose interface through the remainder of a mouthpiece. A mouthpiece hole may be a cylindrical hole.

A mouthpiece of the present specification may include a mouth interface. A mouth interface may be a portion of a mouthpiece designed to interact with a mouth or lips of a user. A user may form a seal with their lips around a mouthpiece interface. A mouthpiece interface may have a shape which enhances a user's ability to seal a user's lips against a mouthpiece. A mouthpiece may have a same or similar shape as a portion of a smoke producer. A mouthpiece may have a same or similar shape as a portion of a standard smoke producer. A standard smoke producer may be a C-Cell style smoke producer or other standard smoke producers.

An integrated smoking device of the present specification may include a smoke producer. A smoke producer may be a vaporizer, vape, or any electronic device used to generate smoke or vapor for inhalation by a user. A smoke producer may be used to generate smoke or vapor. A smoke producer may generate smoke or vapor which is transported by a smoking device to a user. A smoke producer may be a standard smoke producer. A standard smoke producer may include a C-Cell style smoke producer or other standard smoke producers.

An integrated smoking device can be assembled using an assembly method. An assembly method may include three or more steps. The first step may be removal of a mouthpiece or an adapter from a hose of a smoking device. The second step may be inserting a hose through a clothing article passage in a clothing article until a portion of the hose is exposed on each side of the clothing article passage. The third step may be reattachment of a mouthpiece, an adapter or both to the hose. The three enumerated steps of the assembly method may be performed in reverse to perform a disassembly method. An assembly method and a disassembly method may be repeated as-required for maintenance of an integrated smoking device.

Illustrative Examples: The following descriptions of the Figures are provided to illustrate the teachings herein but are not intended to limit the scope thereof.

FIG. 1 is a front view of the integrated smoking device 10. The integrated smoking device 10 includes a clothing article 12. The clothing article 12 has a clothing article passage 14 (not visible) through a hood of the clothing article 12. The clothing article 12 has a pocket 15 on the front of the clothing article 12 which may store a smoke producer 32. Similarly, the clothing article 12 may have a second pocket 17 on the front of the clothing article 12 which may store a mouth piece 34. The clothing article 12 has a warning tag 16 attached to a lower portion of the clothing article 12. The clothing article 12 houses a smoking device 18 in the clothing article passage 14.

The integrated smoking device 10 includes a smoking device 18. The smoking device 18 is formed of an adapter 22, a hose 20, and a mouthpiece 34 connected in series. The adapter 22 is in fluid communication with the mouthpiece 34 through the hose 20. The hose 20 passes through the clothing article passage 14 of the clothing article 12. The adapter 22 is attached to a smoke producer 32 and the hose 20. The mouthpiece 34 is attached to the hose 20.

Figure 2:
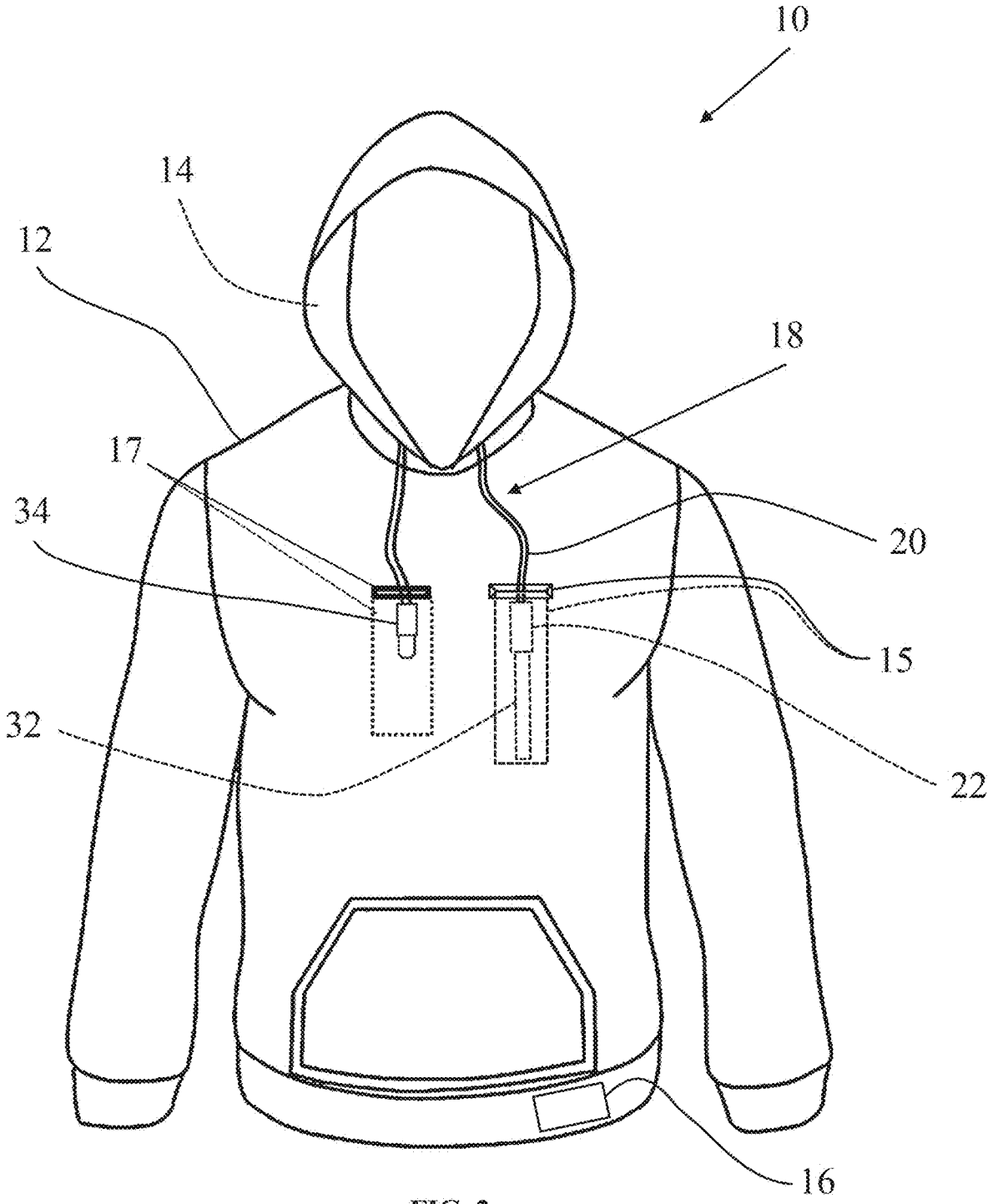
FIG. 2 is a front view of an integrated smoking device in accordance with one or more embodiments shown and described herein.

FIG. 2 is a front view of the integrated smoking device 10. The integrated smoking device 10 includes a clothing article 12. The clothing article 12 has a clothing article passage 14 (not visible) through a hood of the clothing article 12. The clothing article 12 has a pocket 15 (partially visible) on the front of the clothing article 12 which has a smoke producer 32 stored inside. The clothing article 12 has a warning tag 16 attached to a lower portion of the clothing article 12. The clothing article 12 houses a smoking device 18 in the clothing article passage 14.

The integrated smoking device 10 includes a smoking device 18. The smoking device 18 is formed of an adapter 22, a hose 20, and a mouthpiece 34 connected in series. The adapter 22 is in fluid communication with the mouthpiece 34 through the hose 20. The hose 20 passes through the clothing article passage 14 of the clothing article 12. The adapter 22 is attached to a smoke producer 32 and the hose 20. The mouthpiece 34 is attached to the hose 20.

In the present embodiment, the clothing article is a hoodie. However, in other embodiments the clothing article 12 may be a jacket, shirt, windbreaker, rain jacket, parka, coat, quarter zip, crew neck sweatshirt, shot sleeve t-shirt . . . or any other similar clothing article, all with or without a hood.

Figure 3:
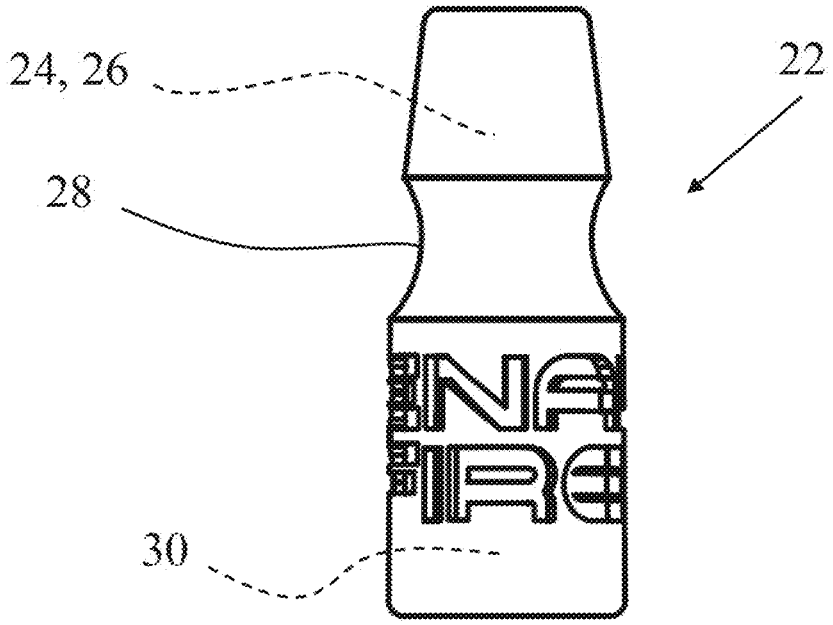
FIG. 3 is a front view of an adapter in accordance with one or more embodiments shown and described herein.

FIG. 3 is a front view of an adapter 22. The adapter 22 has a generally hollow cylindrical shape. The adapter 22 has a hose interface 24 (not visible) inside the top of the adapter 22. The adapter 22 has a smoke producer interface 30 (not visible) inside the bottom of the adapter 22. The hose interface 24 and the smoke producer interface 30 create a continuous hole though the adapter 22. The hose interface 24 has hose grippers 26 (not visible) on its surface. The adapter 22 has a finger grip 28 on its exterior surface.

Figure 4:
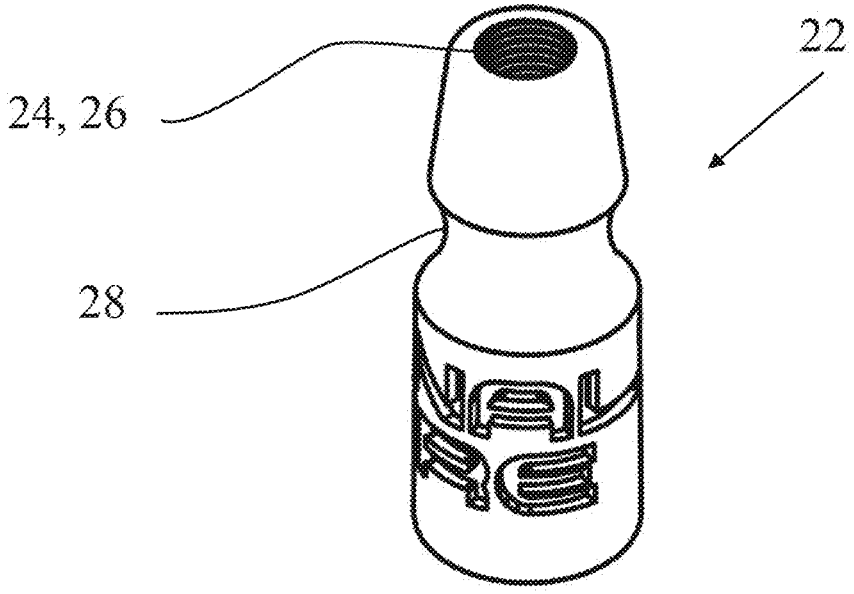
FIG. 4 is a view of a front and a top of an adapter in accordance with one or more embodiments shown and described herein.

FIG. 4 is a view of a front and a top of an adapter 22. The adapter 22 has a finger grip 28 on its exterior surface. The adapter 22 has a hose interface 24 inside the top of the adapter 22. The hose interface 24 has hose grippers 26 on its surface.

Figure 5:
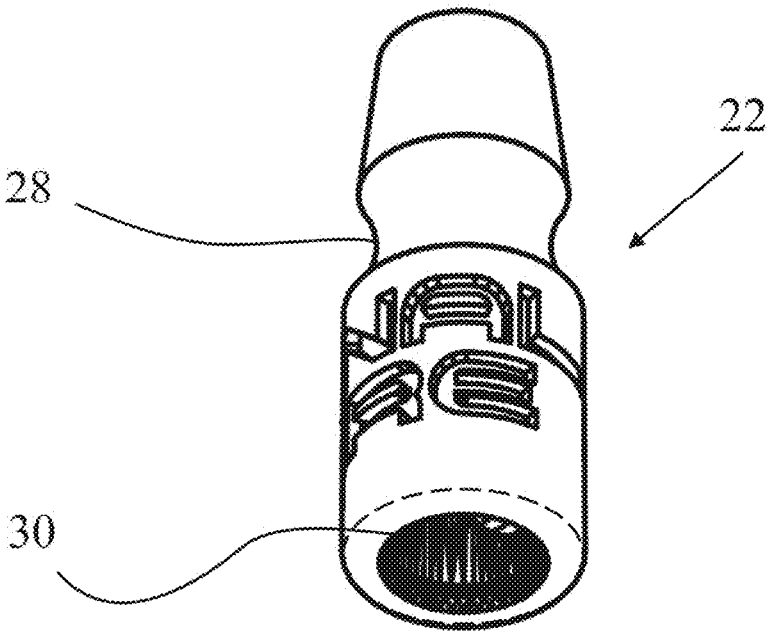
FIG. 5 is a view of a front and a bottom of an adapter in accordance with one or more embodiments shown and described herein.

FIG. 5 is a view of a front and a bottom of an adapter 22. The adapter 22 has a finger grip 28 on its exterior surface. The adapter 22 has a smoke producer interface 30 inside the bottom of the adapter 22.

Figure 6:
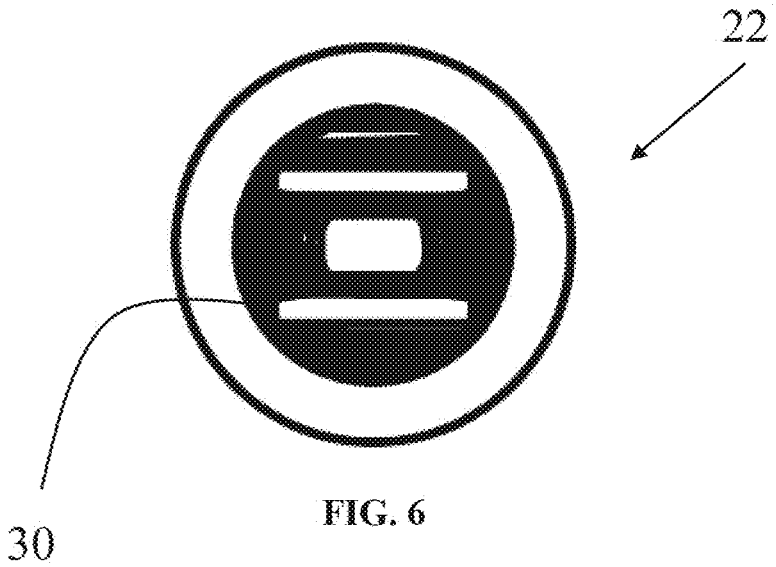
FIG. 6 is a bottom view of an adapter in accordance with one or more embodiments shown and described herein.

FIG. 6 is a bottom view of an adapter 22. The adapter 22 has a smoke producer interface 30 inside the bottom of the adapter 22.

Figure 7:
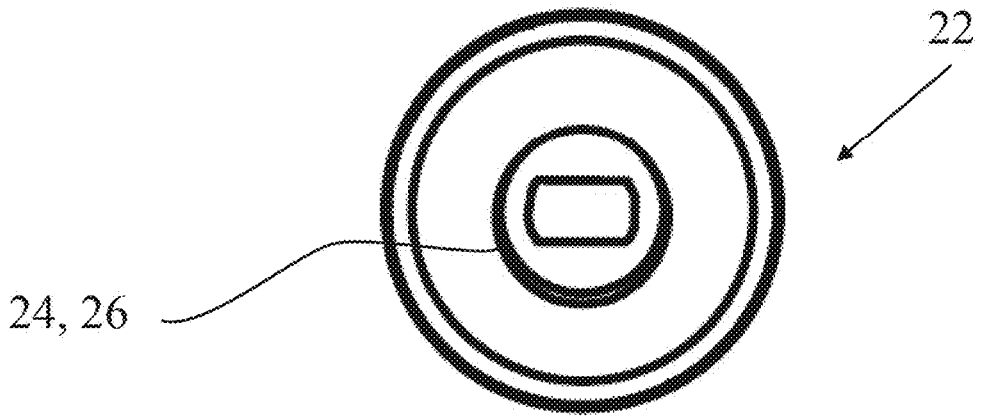
FIG. 7 is a top view of an adapter in accordance with one or more embodiments shown and described herein.

FIG. 7 is a top view of an adapter 22. The adapter 22 has a hose interface 24 inside the top of the adapter 22. The hose interface 24 has hose grippers 26 on its surface.

Figure 8:
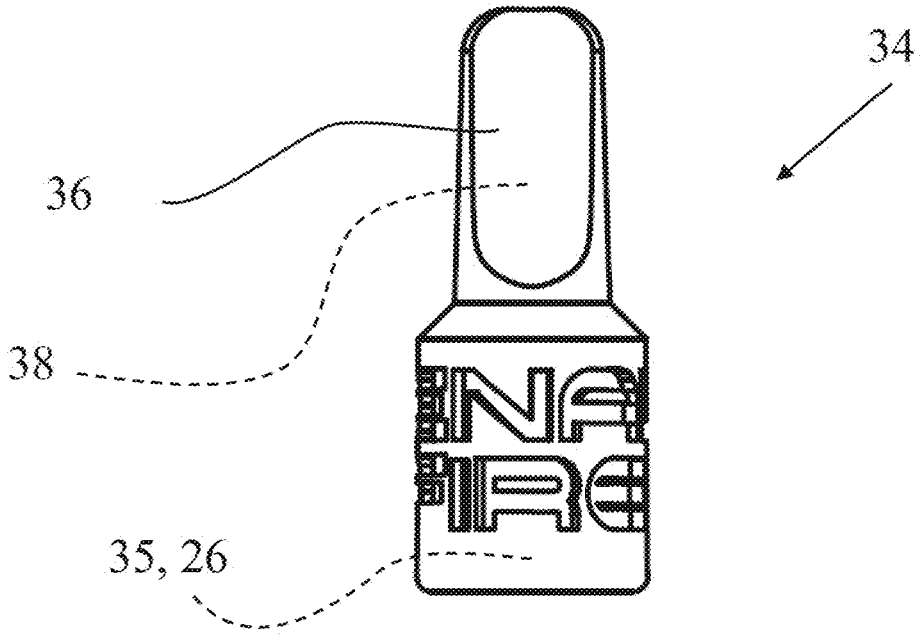
FIG. 8 is a front view of a mouthpiece in accordance with one or more embodiments shown and described herein.

FIG. 8 is a front view of a mouthpiece 34. The mouthpiece 34 has a generally hollow cylindrical shape. The mouthpiece 34 has a mouthpiece hose interface 35 (not visible) inside the bottom of the mouthpiece 34. The mouthpiece 34 has a mouthpiece hole 38 (not visible) inside the top of the mouthpiece 34. The mouthpiece hose interface 35 and mouthpiece hole 38 create a continuous hole through the mouthpiece 34. The mouthpiece hose interface 35 has hose grippers 26 (not visible) on its surface. The mouthpiece 34 has a mouth interface 36 as an upper portion of the mouthpiece 34.

Figure 9:
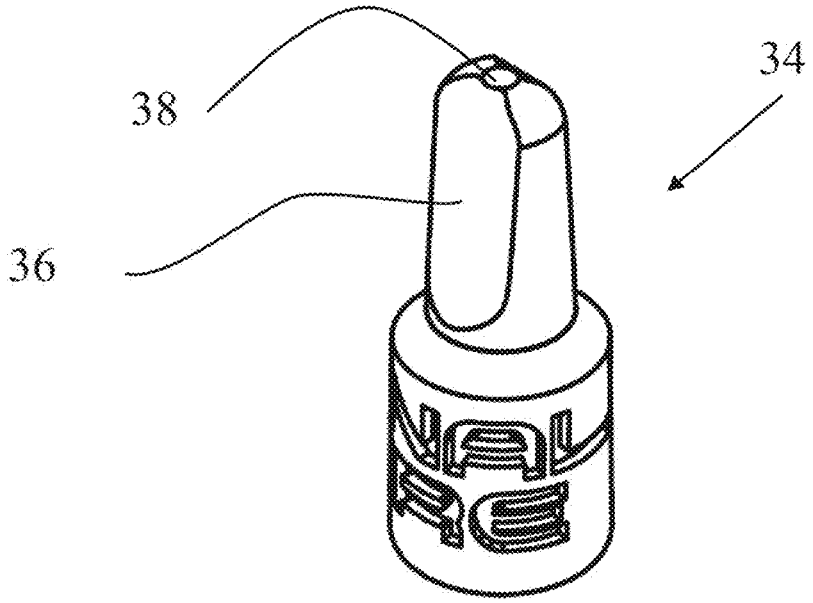
FIG. 9 is a view of a front and a top of a mouthpiece in accordance with one or more embodiments shown and described herein.

FIG. 9 is a view of a front and a top of a mouthpiece 34. The mouthpiece 34 has a mouth interface 36 as an upper portion of the mouthpiece 34. The mouthpiece 34 has a mouthpiece hole 38 inside the top of the mouthpiece 34.

Figure 10:
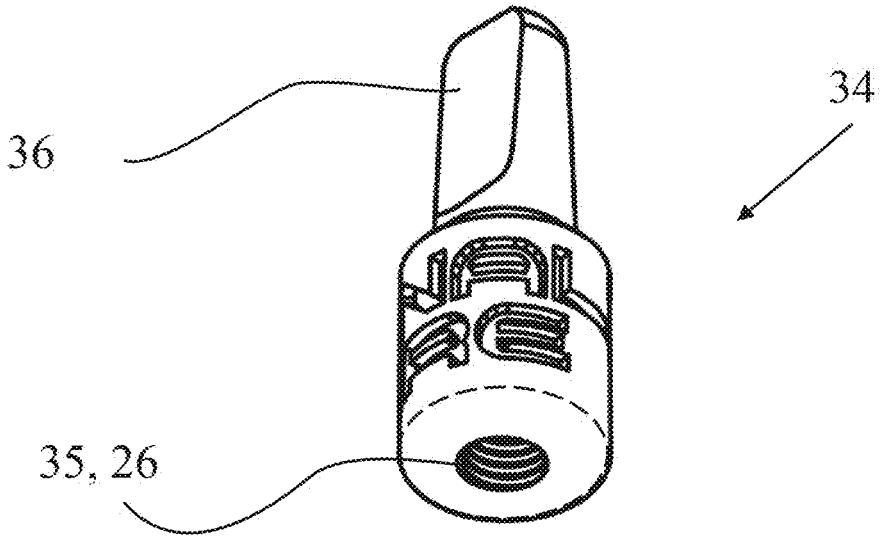
FIG. 10 is a view of a front and a bottom of a mouthpiece in accordance with one or more embodiments shown and described herein.

FIG. 10 is a view of a front and a bottom of a mouthpiece 34. The mouthpiece 34 has a mouth interface 36 as an upper portion of the mouthpiece 34. The mouthpiece 34 has a mouthpiece hose interface 35 inside the bottom of the mouthpiece 34. The mouthpiece hose interface 35 has hose grippers 26 on its surface.

Figure 11:
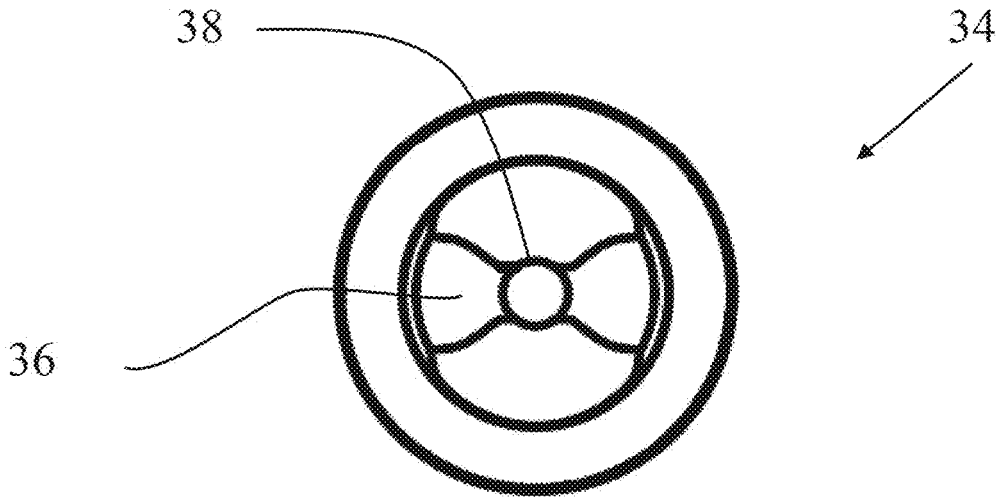
FIG. 11 is a top view of a mouthpiece in accordance with one or more embodiments shown and described herein.

FIG. 11 is a top view of a mouthpiece 34. The mouthpiece 34 has a mouth interface 36 as an upper portion of the mouthpiece 34. The mouthpiece 34 has a mouthpiece hole 38 inside the top of the mouthpiece 34.

Figure 12:
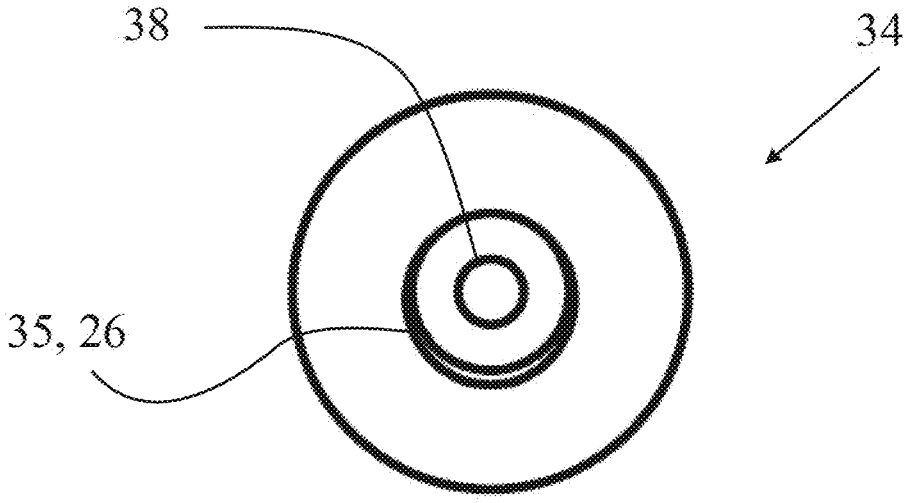
FIG. 12 is a bottom view of a mouthpiece in accordance with one or more embodiments shown and described herein.

FIG. 12 is a bottom view of a mouthpiece 34. The mouthpiece 34 has a mouthpiece hole 38 inside the top of the mouthpiece 34. The mouthpiece 34 has a mouthpiece hose interface 35 inside the bottom of the mouthpiece 34. The mouthpiece hose interface 35 has hose grippers 26 on its surface.

Figure 13:
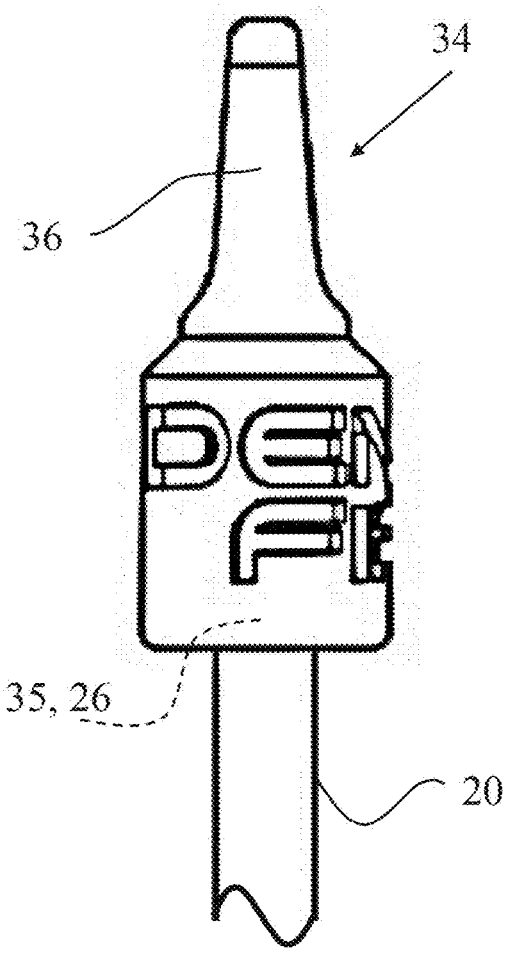
FIG. 13 illustrates a mouthpiece connected to a hose in accordance with one or more embodiments shown and described herein.

FIG. 13 illustrates a mouthpiece 34 connected to a hose 20. The mouthpiece 34 has a mouth interface 36 as an upper portion of the mouthpiece 34. The hose 20 is connected to a mouthpiece hose interface 35 at the bottom of the mouthpiece 34. The mouthpiece hose interface 35 grips the hose with hose grippers 26.

Figure 14:
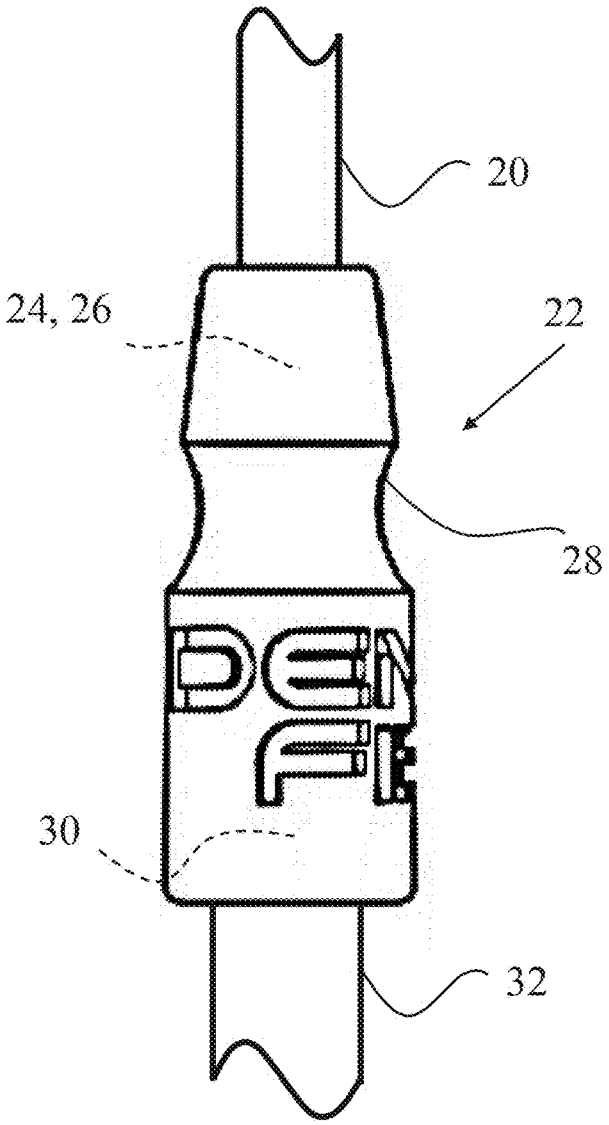
FIG. 14 illustrates an adapter connected to a hose and a smoke producer in accordance with one or more embodiments shown and described herein.

FIG. 14 illustrates an adapter 22 connected to a hose 20 and a smoke producer 32. The adapter 22 has a finger grip 28 around an exterior perimeter of the adapter 22. The adapter 22 is attached to a smoke producer 32 through the smoke producer interface 30. The adapter 22 is attached to the hose 20 through a hose interface 24. The hose interface 24 grips the hose with hose grippers 26.

Figure 15:
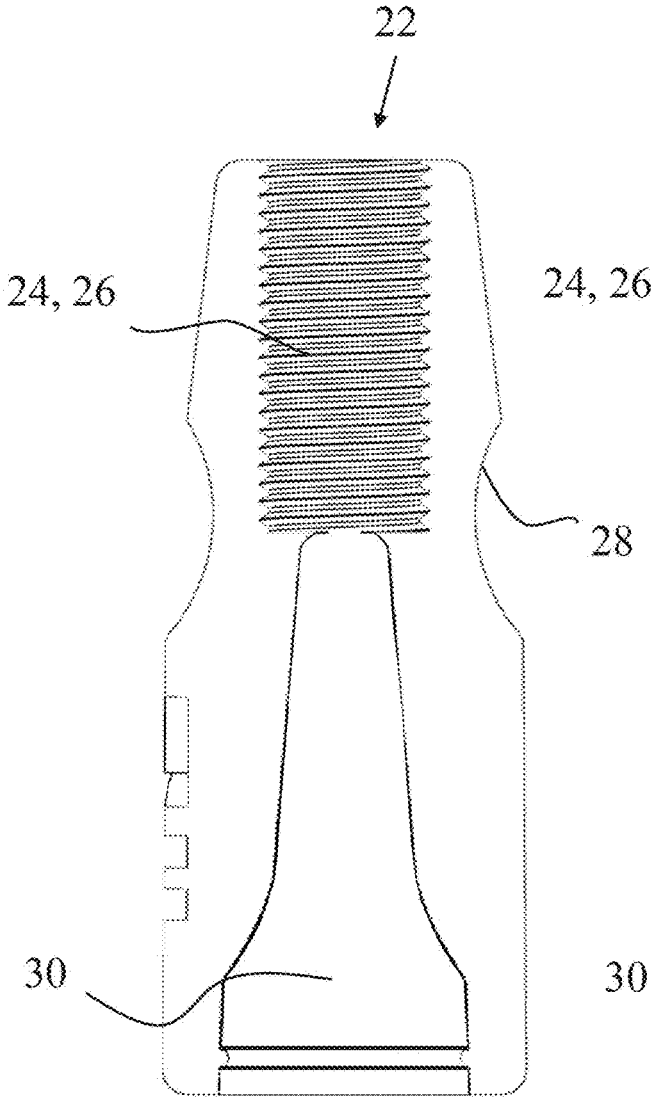
FIG. 15 illustrates a right cross section of an adapter in accordance with one or more embodiments shown and described herein.

FIG. 15 illustrates a right cross section of an adapter 22. The adapter 22 has a generally hollow cylindrical shape. The adapter 22 has a hose interface 24 inside the top of the adapter 22. The adapter 22 has a smoke producer interface 30 inside the bottom of the adapter 22. The hose interface 24 and the smoke producer interface 30 create a continuous hole though the adapter 22. The hose interface 24 has hose grippers 26 on its surface. The adapter 22 has a finger grip 28 on its exterior surface.

Figure 16:
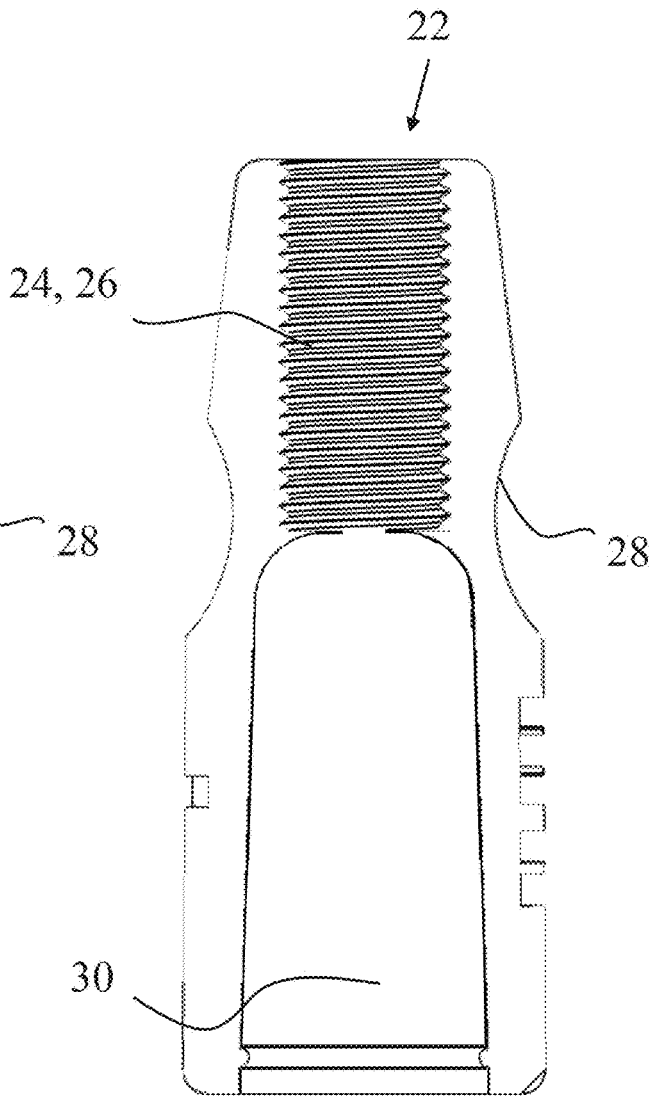
FIG. 16 illustrates a front cross section of an adapter in accordance with one or more embodiments shown and described herein.

FIG. 16 illustrates a front cross section of an adapter 22. The adapter 22 has a generally hollow cylindrical shape. The adapter 22 has a hose interface 24 inside the top of the adapter 22. The adapter 22 has a smoke producer interface 30 inside the bottom of the adapter 22. The hose interface 24 and the smoke producer interface 30 create a continuous hole though the adapter 22. The hose interface 24 has hose grippers 26 on its surface. The adapter 22 has a finger grip 28 on its exterior surface.

Figure 17:
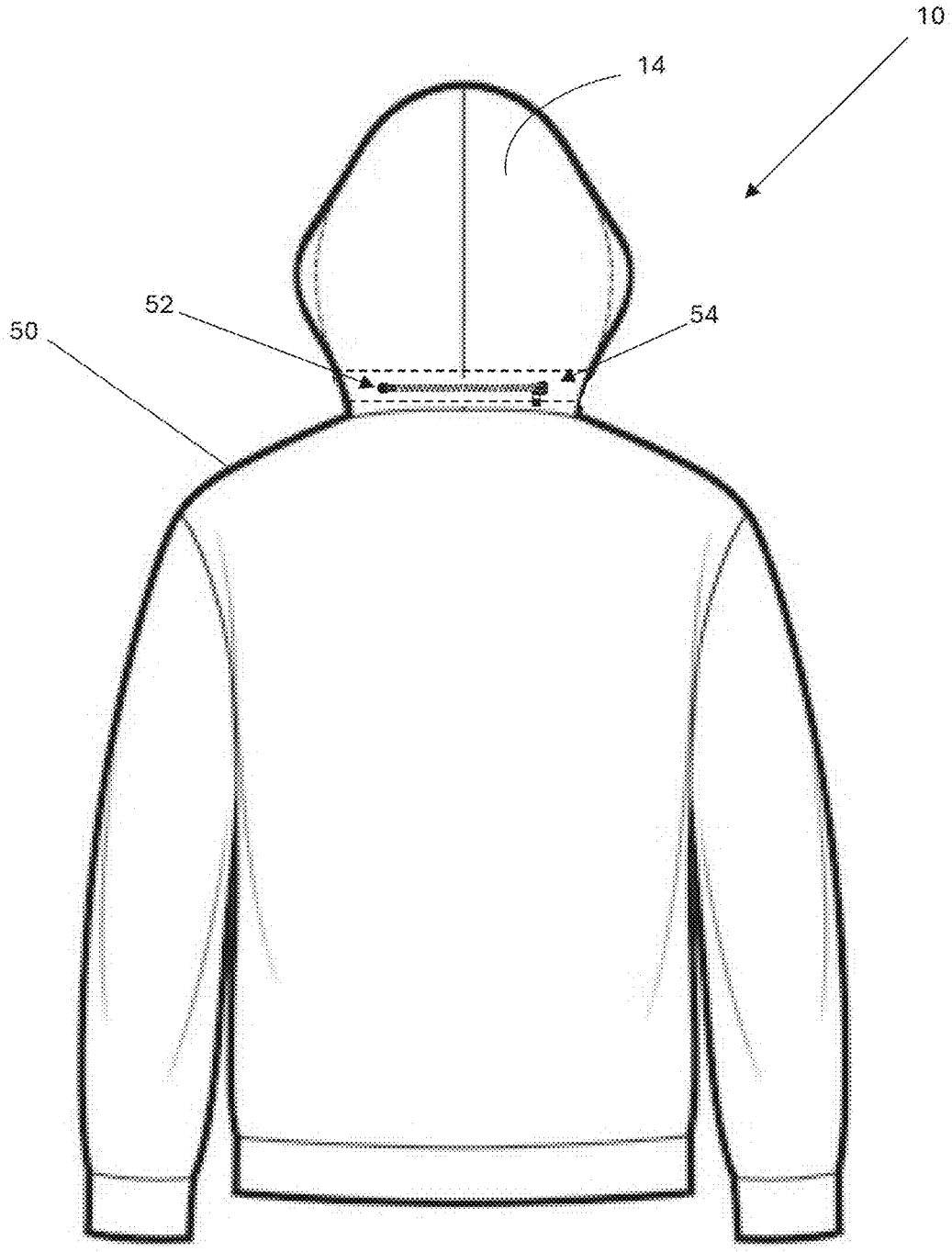
FIG. 17 illustrates a rear view of the hoodie in accordance with one or more embodiments shown and described herein.

FIG. 17 depicts the hose positioned around the collar of the user's neck. In this configuration, a pocket 54, positioned between a torso portion 50, a hood portion 14, or somewhere between the two is provided. This is alternative to a hose being positioned where a drawstring of a hood is traditionally placed. In the present embodiment, a zipper 54 is used to access the hose 54 (or the pocket 54) through the access opening.

Hooded Sweatshirt Construction includes a Torso Covering Portion. The sweatshirt includes a torso covering portion that includes a front torso portion and a rear torso portion. This design ensures full coverage and traditional hoodie aesthetics.

Hood: Attached to the upper edge of the torso covering portion, the hood includes a rear portion extending over the back of the wearer's head. The hood provides additional coverage and warmth, typical of standard hooded sweatshirts.

Collar Section: Positioned between the torso covering portion and the hood, the collar section is designed to encircle the user's neck. The collar includes an internal pocket that extends around the user's neck, discreetly housing the integrated hose.

Sleeves: A pair of sleeves extend from the torso covering portion, providing coverage for the wearer's arms. The sleeves are designed for comfort and mobility, consistent with traditional sweatshirt designs.

Front Pocket: Located on the front side of the torso covering portion, the pocket offers storage space for personal items. This pocket maintains the practical aspects of conventional hooded sweatshirts.

Integrated Hose with Vapor Cartridge: A hose is integrated into the collar, with a vapor cartridge connected to it. The hose is positioned within the internal pocket 54 of the collar (also shown near 54), ensuring it is discreet and protected. The outlet of the hose is positioned near the wearer's face, allowing for easy vapor inhalation.

Access Opening 52: An access opening is positioned on the rear portion of the hood or the rear torso portion. This opening is designed to be only large enough to access a portion of the hose, ensuring that the vapor system remains concealed and secure.

Access Opening Features a Zipper Access. In one embodiment, the access opening is accessible via a zipper. This allows for easy access to the hose and vapor cartridge for maintenance or replacement while ensuring the opening remains securely closed during use.

Size Specifications: The access opening is designed to be no larger than 4 inches. This size restriction ensures the opening is discreet and minimally impacts the overall aesthetics of the sweatshirt.

Length Range: The access opening length is specified to be between 1 and 5 inches, providing enough space for functional access without compromising the garment's design.

Figure 18:
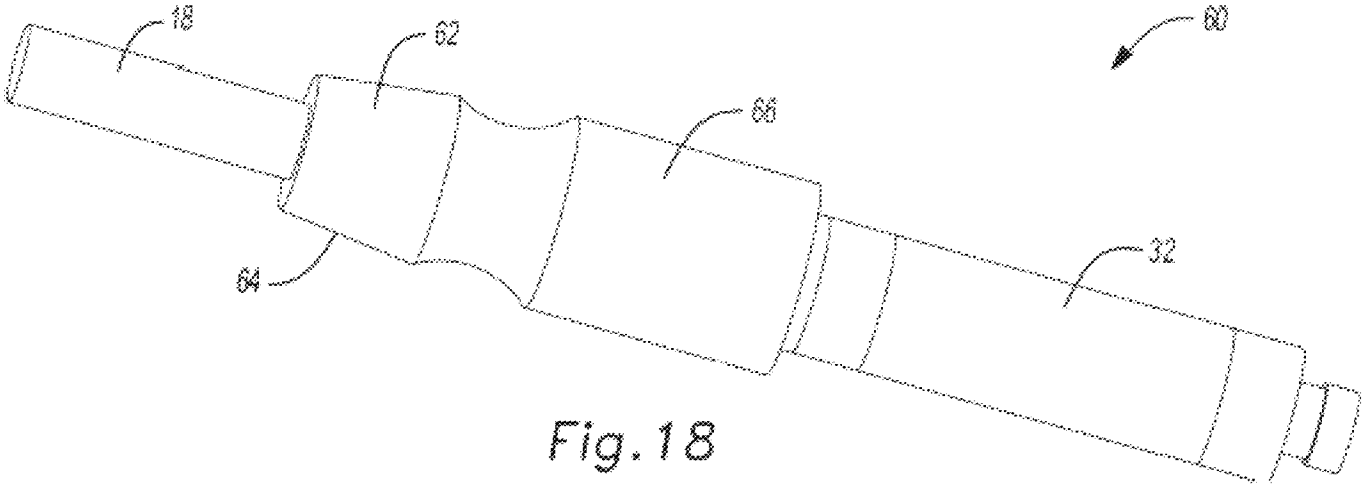
FIG. 18 illustrates a perspective view of a universal adapter with cartridge attached in accordance with one or more embodiments shown and described herein.
Figure 19:
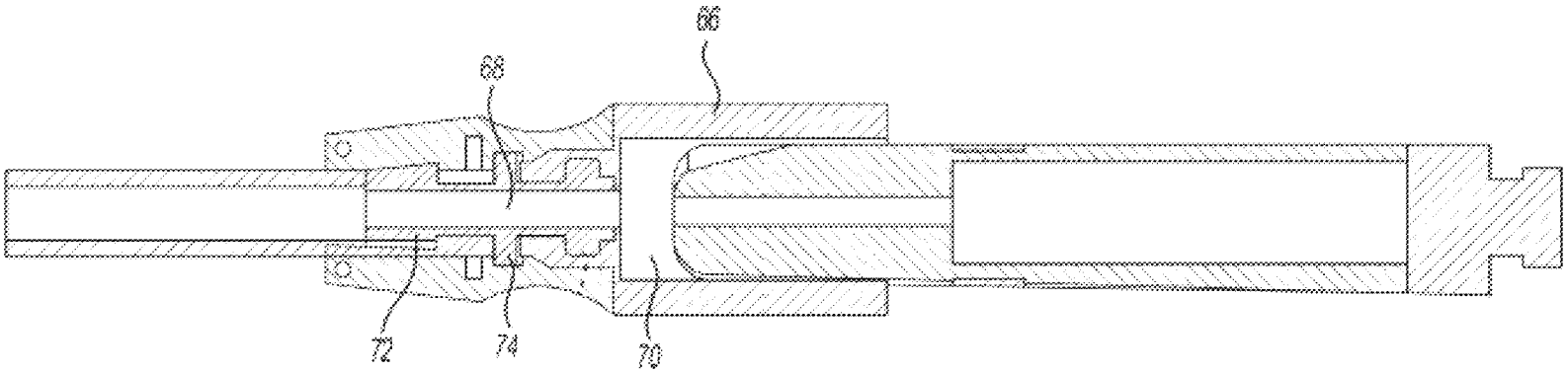
FIG. 19 illustrates a perspective partial cross section view of a universal adapter with cartridge attached in accordance with one or more embodiments shown and described herein.

A Vapor Cartridge Universal Connector is shown in FIGS. 18 and 19. A Main Housing 66 is provided. The vapor cartridge universal connector includes a main housing 66 designed to securely connect to the vapor cartridge 32. This housing ensures the cartridge remains firmly in place during use.

Secondary Housing 62, 64: Connected to the main housing 66, the secondary housing features a split shell configuration 62, 64 with a first portion and a second portion. This design allows for easy attachment and secure connection.

Barb Connector 68: Positioned between the first and second portions of the secondary housing, the barb connector is inserted into the hose of the hooded sweatshirt. The split shell configuration of the secondary housing is designed to tightly compress around the barb, ensuring a secure connection between the universal connector, the vapor cartridge, and the hose. The barb connector 68 may include a plurality of barbs 70, 72, 74 to further support connection to the internal portion of the secondary connector split shell.

The hooded sweatshirt with an integrated vapor cartridge system provides a unique and functional garment that allows users to discreetly enjoy vapor. The combination of traditional hoodie features with advanced vapor delivery technology ensures comfort, convenience, and style. The design considerations, such as the integrated hose, internal pocket, and secure connections, highlight the innovation and practicality of this invention.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

It is noted that the terms "substantially" and "about" may be utilized herein to represent the inherent degree of uncertainty that may be attributed to any quantitative comparison, value, measurement, or other representation.

These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter.

Unless otherwise stated, any numerical values recited herein include all values from the lower value to the upper value in increments of one unit provided that there is a separation of at least 2 units between any lower value and any higher value. As an example, if it is stated that the amount of a component, a property, or a value of a process variable such as, for example, temperature, pressure, time and the like is, for example, from 1 to 90, preferably from 20 to 80, more preferably from 30 to 70, it is intended that intermediate range values such as (for example, 15 to 85, 22 to 68, 43 to 51, 30 to 32 etc.) are within the teachings of this specification. Likewise, individual intermediate values are also within the present teachings. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of, or even consist of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps. All references herein to elements or metals belonging to a certain Group refer to the Periodic Table of the Elements published and copyrighted by CRC Press, Inc., 1989. Any reference to the Group or Groups shall be to the Group or Groups as reflected in this Periodic Table of the Elements using the IUPAC system for numbering groups.

While particular embodiments have been illustrated and described herein, it should be understood that various other changes and modifications may be made without departing from the spirit and scope of the claimed subject matter.

Moreover, although various aspects of the claimed subject matter have been described herein, such aspects need not be utilized in combination.

It is therefore intended that the appended claims (and/or any future claims filed in any Utility application) cover all such changes and modifications that are within the scope of the claimed subject matter.

Moreover, although various aspects of the claimed subject matter have been described herein, such aspects need not be utilized in combination.

It is therefore intended that the appended claims cover all such changes and modifications that are within the scope of the claimed subject matter.

The invention claimed is:

1. A vapor cartridge universal connector, wherein the vapor cartridge universal connector is adapted to be integrated into a clothing article, the clothing article including a hose positioned around a collar of a user's neck when worn, and wherein the vapor cartridge universal connector comprises:

a main housing, the main housing configured to connect to a vapor cartridge;

a secondary housing connected to the main housing, the secondary housing having a first portion and a second portion in a split shell configuration; and a barb connector, the barb connector positioned between the first portion and the second portion of the secondary housing, the barb connector configured to be inserted into the hose; and wherein the split shell configuration of the secondary connector is configured to tightly compress around the barb connector so as to securely connect the vapor cartridge universal connector and the vapor cartridge to the hose.

* * * * *